US008640667B2

(12) United States Patent
Hisada et al.

(10) Patent No.: US 8,640,667 B2
(45) Date of Patent: Feb. 4, 2014

(54) FIXING STRUCTURES FOR INTAKE MANIFOLDS

(75) Inventors: Ichiro Hisada, Tokoname (JP); Shoubin Han, Nagoya (JP); Hironori Tanikawa, Anjo (JP)

(73) Assignee: Aisan Kogyo Kabushiki Kaisha, Obu-Shi, Aichi-Ken (JP)

( * ) Notice: Subject to any disclaimer, the term of this patent is extended or adjusted under 35 U.S.C. 154(b) by 344 days.

(21) Appl. No.: 12/985,676

(22) Filed: Jan. 6, 2011

(65) Prior Publication Data

US 2011/0168121 A1 Jul. 14, 2011

(30) Foreign Application Priority Data

Jan. 12, 2010 (JP) ..... 2010-003710

(51) Int. Cl.
*F02M 35/10* (2006.01)

(52) U.S. Cl.
USPC ..... 123/184.21; 123/184.22; 123/184.23; 123/184.24; 123/184.25; 123/184.26; 123/184.27; 123/184.28; 123/184.29; 123/184.31; 123/184.32; 123/184.33; 123/184.34; 123/184.35; 123/184.36; 123/184.37; 123/184.38; 123/184.39; 123/184.41; 123/184.42; 123/184.43; 123/184.44; 123/184.45; 123/184.46; 123/184.47; 123/184.48; 123/184.49; 123/184.51; 123/184.52; 123/184.53; 123/184.54; 123/184.55; 123/184.56; 123/184.57; 123/184.58; 123/184.59; 123/184.61

(58) Field of Classification Search
USPC ..... 123/184.21, 184.22, 184.23, 184.24, 123/184.25, 184.26, 184.27, 184.28, 123/184.29, 184.31, 184.32, 184.33, 123/184.34, 184.35, 184.36, 184.37, 123/184.38, 184.39, 184.41, 184.42, 123/184.43, 184.44, 184.45, 184.46, 123/184.47, 184.48, 184.49, 184.51, 123/184.52, 184.53, 184.54, 184.55, 123/184.56, 184.57, 184.58, 184.59, 184.61
See application file for complete search history.

(56) References Cited

U.S. PATENT DOCUMENTS

| | | | | |
|---|---|---|---|---|
| 3,024,774 | A * | 3/1962 | Eby, Jr. | 123/184.39 |
| 3,360,008 | A * | 12/1967 | Childers et al. | 137/594 |
| 5,564,377 | A * | 10/1996 | Azuma | 123/184.34 |
| 6,363,900 | B1 * | 4/2002 | Homi et al. | 123/184.21 |
| 2003/0015160 | A1 * | 1/2003 | Vichinsky | 123/184.42 |
| 2003/0024496 | A1 * | 2/2003 | Tachibana et al. | 123/184.47 |
| 2003/0106516 | A1 * | 6/2003 | Nishimura et al. | 123/184.42 |
| 2004/0200449 | A1 * | 10/2004 | Lang | 123/184.21 |
| 2005/0005890 | A1 * | 1/2005 | Asfaw et al. | 123/184.61 |
| 2005/0028777 | A1 * | 2/2005 | Yang | 123/184.21 |
| 2006/0027203 | A1 * | 2/2006 | Cunningham et al. | 123/184.47 |

FOREIGN PATENT DOCUMENTS

| | | |
|---|---|---|
| JP | 2001342917 | 12/2001 |
| JP | 2003201928 | 7/2003 |

OTHER PUBLICATIONS

Japanese Office Action dated May 20, 2013, corresponding to Japanese Patent Application No. 2010-003710, with full English language translation.

* cited by examiner

*Primary Examiner* — Lindsay Low
*Assistant Examiner* — Charles Brauch
(74) *Attorney, Agent, or Firm* — Ladas & Parry LLP

(57) ABSTRACT

A mounting device can mount an intake manifold to an engine and includes a bending moment applying device applying a bending moment to the intake manifold as the intake manifold is mounted to the engine.

10 Claims, 9 Drawing Sheets

FIXING STRUCTURES FOR INTAKE MANIFOLDS

This application claims priority to Japanese patent application serial number 2010-003710, the contents of which are incorporated herein by reference.

BACKGROUND OF THE INVENTION

1. Field of the Invention

The present invention relates to structures for fixing intake manifolds to engines.

2. Description of the Related Art

A known fixing structure for an intake manifold that distributes intake air to cylinders of a multi-cylinder engine is disclosed in Japanese Laid-Open Patent Publication No. 2003-201928. This fixing structure includes a first mounting device for fixing an end portion on an air inlet side of the intake manifold to the engine, and a second mounting device for fixing an air outlet side of the intake manifold to the engine. With each of the first and second mounting devices, an angle between an installation surface provided on the engine and a mount surface provided on the intake manifold for joining to the installation surface is set to be zero in a free state (non-fixed state) of the intake manifold. Therefore, no bending moment is applied to the intake manifold when the intake manifold is fixed to the engine.

However, in the case of the known fixing structure, there has been a problem known as "waving phenomenon" that generates local vibrations at a portion or portions (such as intake pipes) having rigidity lower than that of the other portion of the intake manifold fixed to the engine. In particular, if the intake pipes are made of resin, large amplitude of local vibrations may be generated.

Therefore, there is a need in the art for preventing or reducing local vibrations of an intake manifold mounted to an engine.

SUMMARY OF THE INVENTION

A mounting device can mount an intake manifold to an engine and includes a bending moment applying device applying a bending moment to the intake manifold as the intake manifold is mounted to the engine.

DETAILED DESCRIPTION OF THE INVENTION

Figure 1:
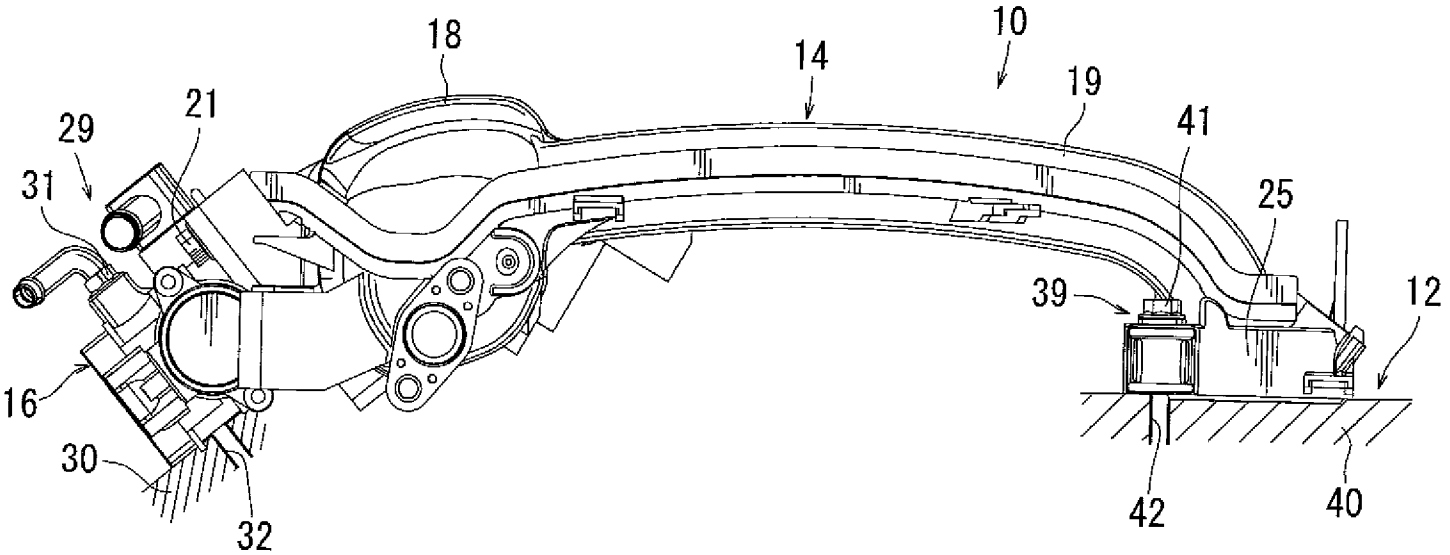
FIG. 1 is a front view of an intake manifold and a fixing structure for fixing the intake manifold to an engine according to a first example.

Each of the additional features and teachings disclosed above and below may be utilized separately or in conjunction with other features and teachings to provide improved mounting devices that can mount an intake manifold to an engine. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a fixing structure for fixing an intake manifold to an engine includes a first mounting device and a second mounting device. The first mounting device can fixedly mount a first end portion on an air inlet side of the intake manifold to the engine by a first fixing force. The second mounting device can fixedly mount a second end portion on an air outlet side of the intake manifold to the engine by a second fixing force. At least one of the first and second fixing forces applies a bending moment to the intake manifold body.

Therefore, it is possible to prevent or reduce local vibrations of the intake manifold, which may be generated at a low rigidity portion (such as intake pipes of a manifold body) of the intake manifold.

The first mounting device may include a first installation surface provided on the engine and a first mount surface provided on the intake manifold for contacting with the first installation surface. The second mounting device may include a second installation surface provided on the engine and a second mount surface provided on the intake manifold for contacting with the second installation surface.

The first installation surface and the first mount surface may be inclined relative to each other by a first angle when the intake manifold is free from the bending moment. Additionally or alternatively, the second installation surface and the second mount surface may be inclined relative to each other by a second angle when the intake manifold is free from the bending moment.

Therefore, it is possible to apply a bending moment to the intake manifold as at least one of the first and second mount surfaces is brought to contact the corresponding installation surface of the engine by the mounting operations of the first and second mounting devices.

The first end portion of the intake manifold may include a throttle body integrated with an air-intake side portion of the manifold body, and the throttle body may include the first mount surface. Therefore, it is possible to apply a bending moment to the intake manifold as the throttle body is mounted to the engine.

Various examples will now be described with reference to the drawings. The examples relate to fixing structures for fixing intake manifolds that are used in outboard engines.

FIRST EXAMPLE

Referring to FIG. 1, an intake manifold 10 is adapted to be mounted on a multi-cylinder engine 12 (a four-cylinder engine in this example).

Figure 2:
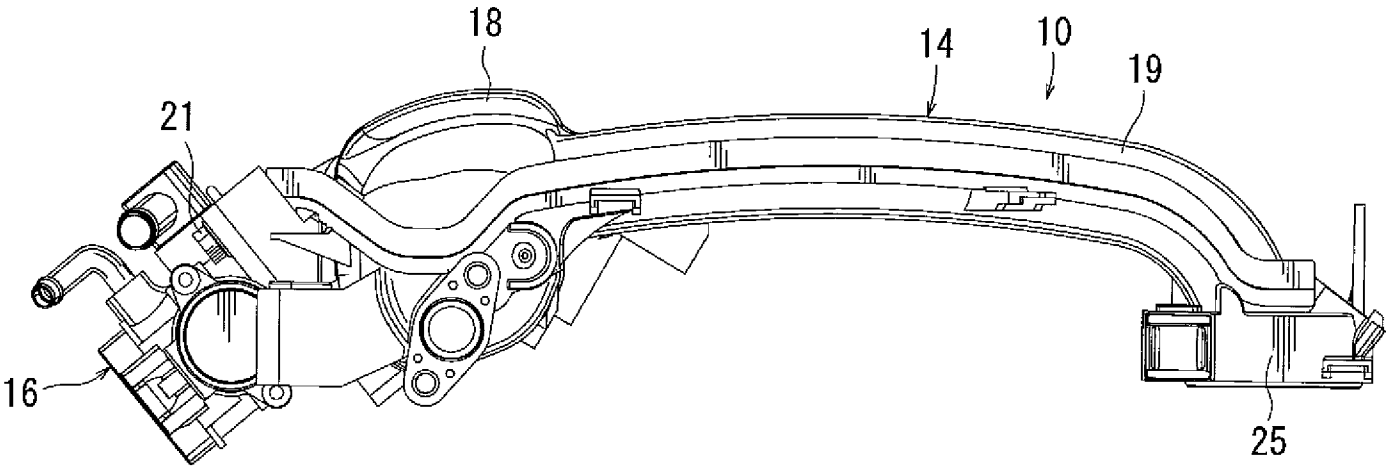
FIG. 2 is a front view of the intake manifold.
Figure 3:
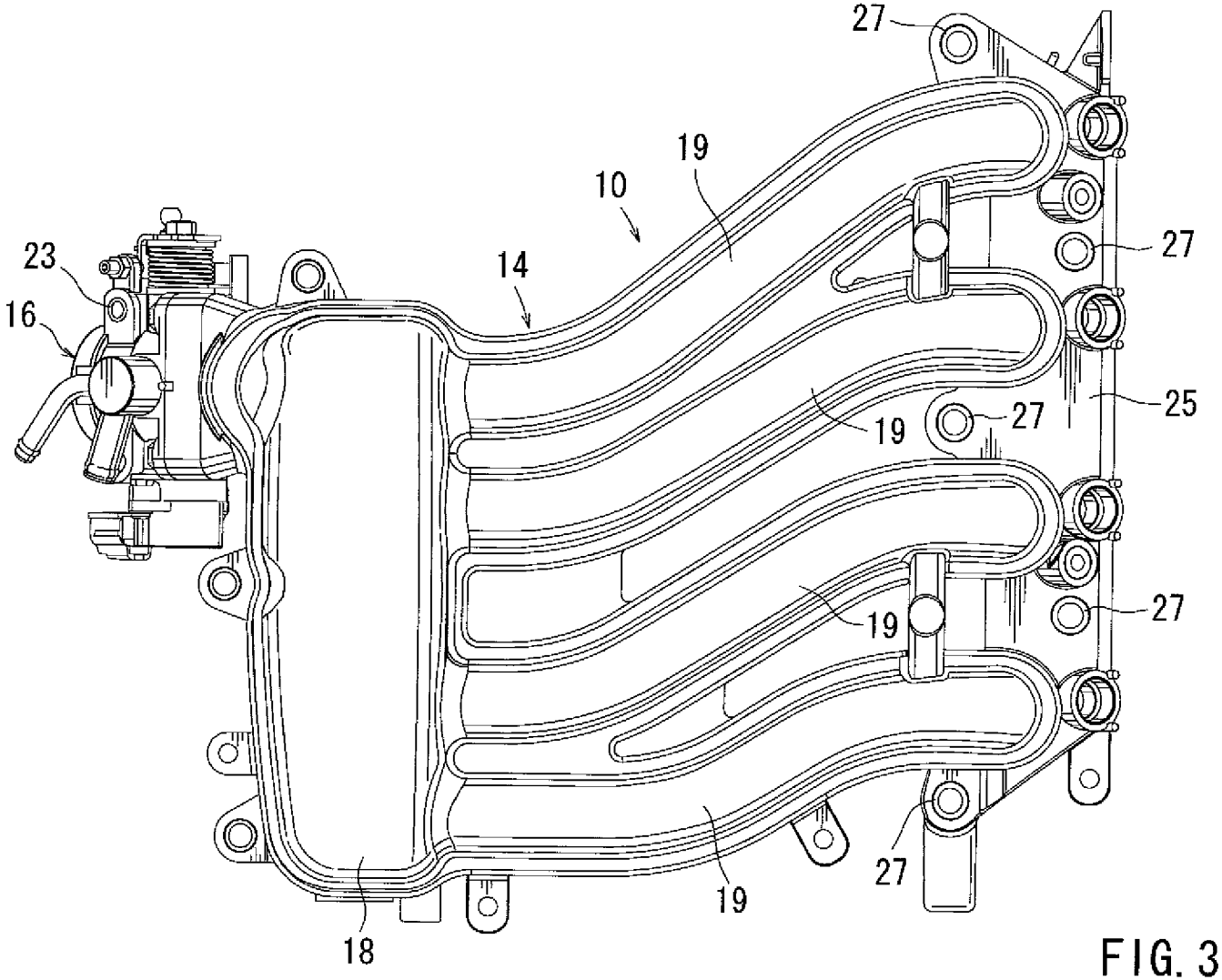
FIG. 3 is a plane view of the intake manifold.
Figure 4:
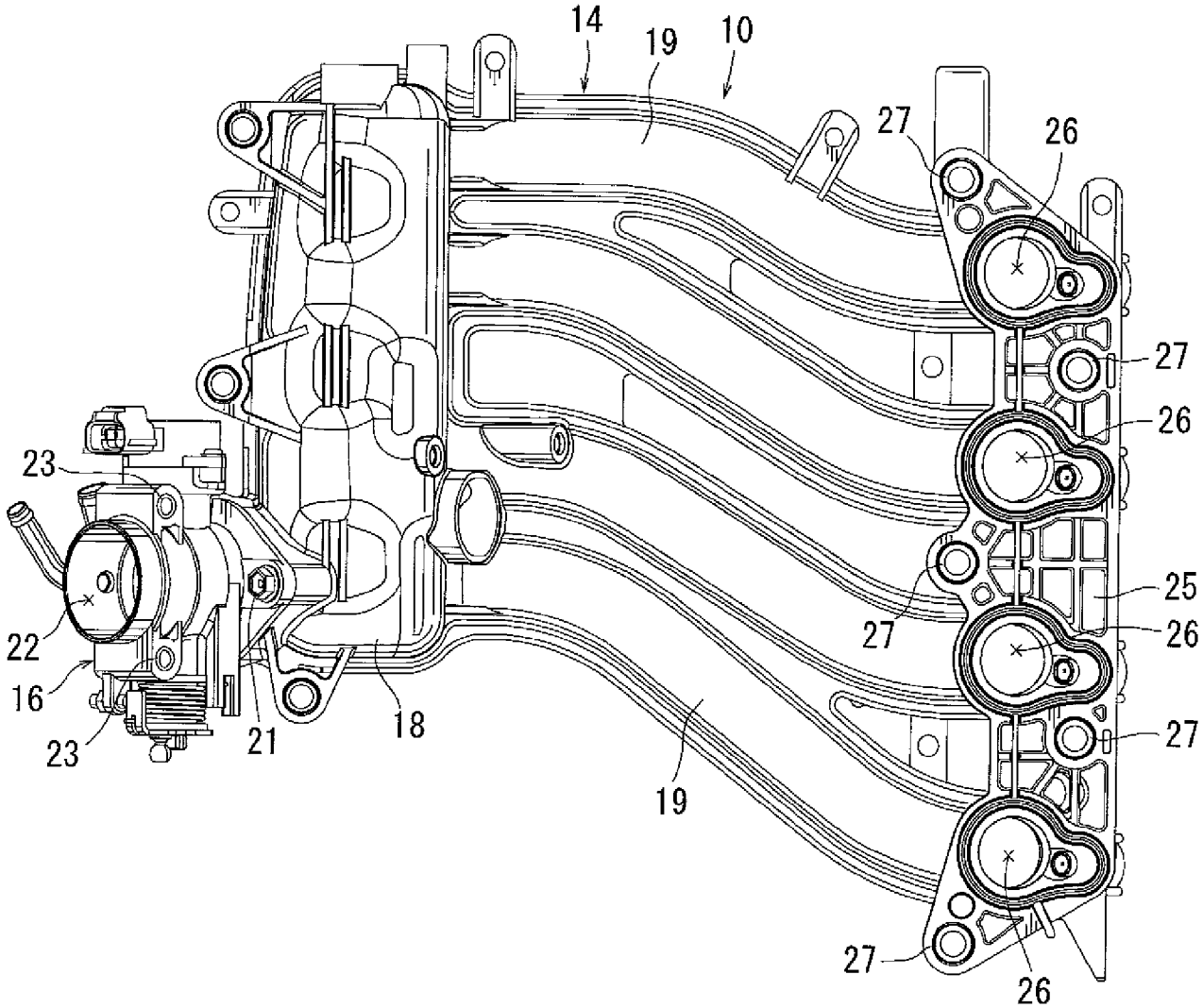
FIG. 4 is a bottom view of the intake manifold.

As shown in FIGS. 2 to 4, the intake manifold 10 includes a manifold body 14 made of resin and a throttle body 16 mounted to one end (left end as viewed in FIGS. 2 to 4) on an air inlet side of the manifold body 14.

As shown in FIGS. 3 and 4, the manifold body 14 includes a surge tank 18 and a plurality of intake pipes 19 that are formed integrally with the surge tank 18. The surge tank 18 is formed on the air inlet side of the manifold body 14. The plurality of intake pipes 19 (four intake pipes 9 are provided in this example) extend rightward from the surge tank 18 for distributing intake air introduced into the surge tank 18, to the respective cylinders of the engine 12.

The intake pipes 9 are arranged in a direction of an array of cylinders of the engine 12 or a forward and rearward direction (an upper and lower direction as viewed in FIGS. 3 and 4). The throttle body 16 is mounted to the left end portion of the surge tank 18 by a plurality of bolts 21 (only one bolt 21 is shown in FIGS. 2 and 4).

The throttle body 16 has an intake air passage 22 defined therein (see FIG. 4) and communicating with the surge tank 18 of the manifold body 14. The throttle body 16 is mounted to the manifold body 16 in a state inclined relative to the manifold body 16, so that the intake air passage 22 extends downward in the left direction (see FIG. 2). A throttle valve (not shown) is mounted within the throttle body 16 for controlling the flow rate of intake air. An upstream side of the throttle body 16 with respect to the intake air passage 22 is connectable with a piping member that communicates with an air cleaner (not shown). The throttle body 16 may be made, for example, of resin and has a pair of right and left first collars 23 made of metal. The first collars 23 are oriented vertically and embedded into opposite side walls (front and rear side walls with respect to the intake air passage 22) of the throttle body 15 by using an insertion molding technique (see FIG. 4). The throttle body 16 and the throttle valve constitute a throttle device.

As shown in FIGS. 2 to 4, a horizontal mount flange 25 is formed with end portions on the air outlet side (right end portions) of the intake pipes 19 of the manifold body 14. Four intake air outlets 26 having open lower ends are formed in the mount flange 25 and are arranged in the front and rear direction (see FIG. 4). A plurality of second collars 27 (five collars 27 are shown in FIGS. 3 and 4) made of metal and oriented vertically are embedded into the outer peripheral portion of the mount flange 25 by using an insertion molding technique.

Figure 5:
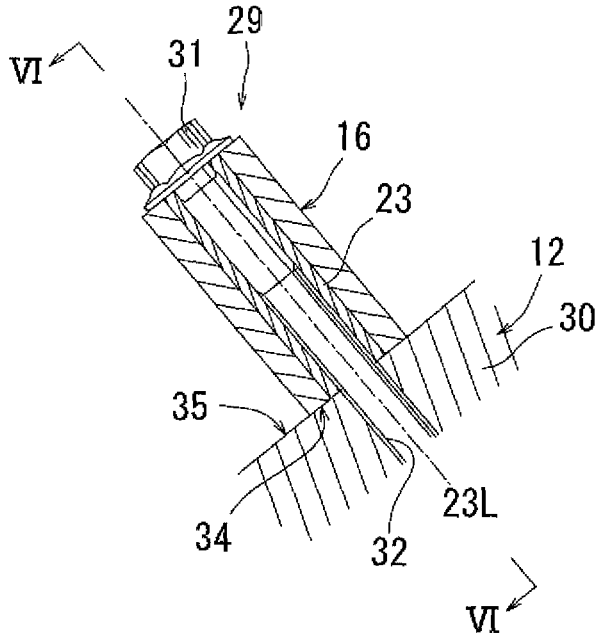
FIG. 5 is a sectional view as viewed from a front side of a first mounting device of the fixing structure.
Figure 6:
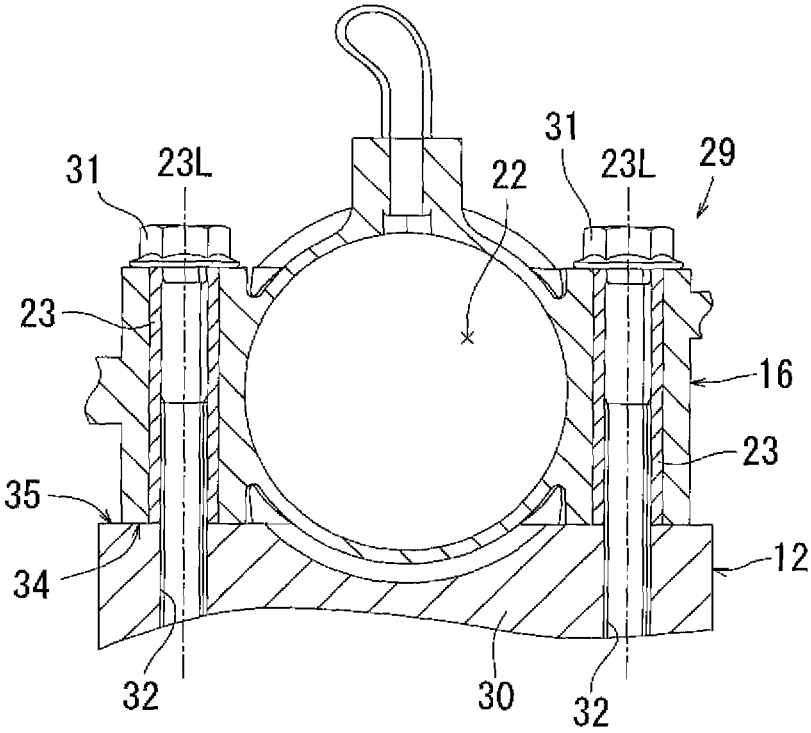
FIG. 6 is a sectional view taken along line VI-VI in FIG. 5.

A first mounting device 29 (see FIG. 1) for fixing the throttle body 16 of the intake manifold 10 to the engine 12 will now be described. Referring to FIGS. 5 and 6, a bracket 30 is fixed to an engine body (more specifically, a cylinder block (not shown)) of the engine 12 and serves as a fixing side member of the engine 12, which is positioned to correspond to the throttle body 16. Therefore, the bracket 30 may be called "an engine side member".

The first mounting device 29 includes first bolts 31 inserted into the first collars 23 of the throttle body 16, respectively, and first threaded holes 32 formed in the bracket 30 and engageable with the respective first bolts 31. A first mount surface 34 is formed on a lower surface of the throttle body 16 and extends perpendicular to axes 23L of the first collars 23 (see FIGS. 5 and 6). On the other hand, a first installation surface 35 is formed on an upper surface of the bracket 30 and positioned to correspond to the first mount surface 34 of the throttle body 16.

Figure 7:
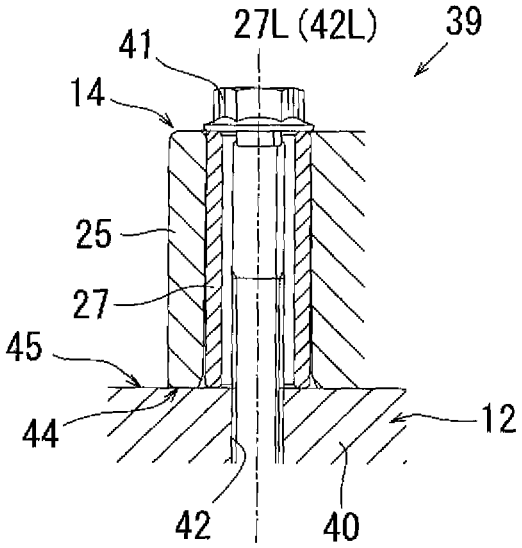
FIG. 7 is a sectional view as viewed from a front side of a second mounting device of the fixing structure.

A second mounting device 39 (see FIG. 1) for mounting the mount flange 25 of the intake manifold 10 to the engine 12 will now be described. Referring to FIG. 7, a cylinder head 40 fixed to the engine body of the engine 12 serves as a fixing side member of the engine 12, which is positioned to correspond to the mount flange 25 of the manifold body 14. Therefore, the cylinder head 40 may be also called "an engine side member".

The second mounting device 39 includes second bolts 41 inserted into the second collars 27 of the mount flange 25 of the manifold body 14, respectively, and second threaded holes 42 formed in the cylinder head 40 and engageable with the respective second bolts 41. A second mount surface 44 is formed on a lower surface of the mount flange 25 and extends perpendicular to axes 27L of the second collars 27. On the other hand, a second installation surface 45 is formed on an upper surface of the cylinder head 40 and positioned to correspond to the second mount surface 44 of the mount flange 25.

Figure 8:
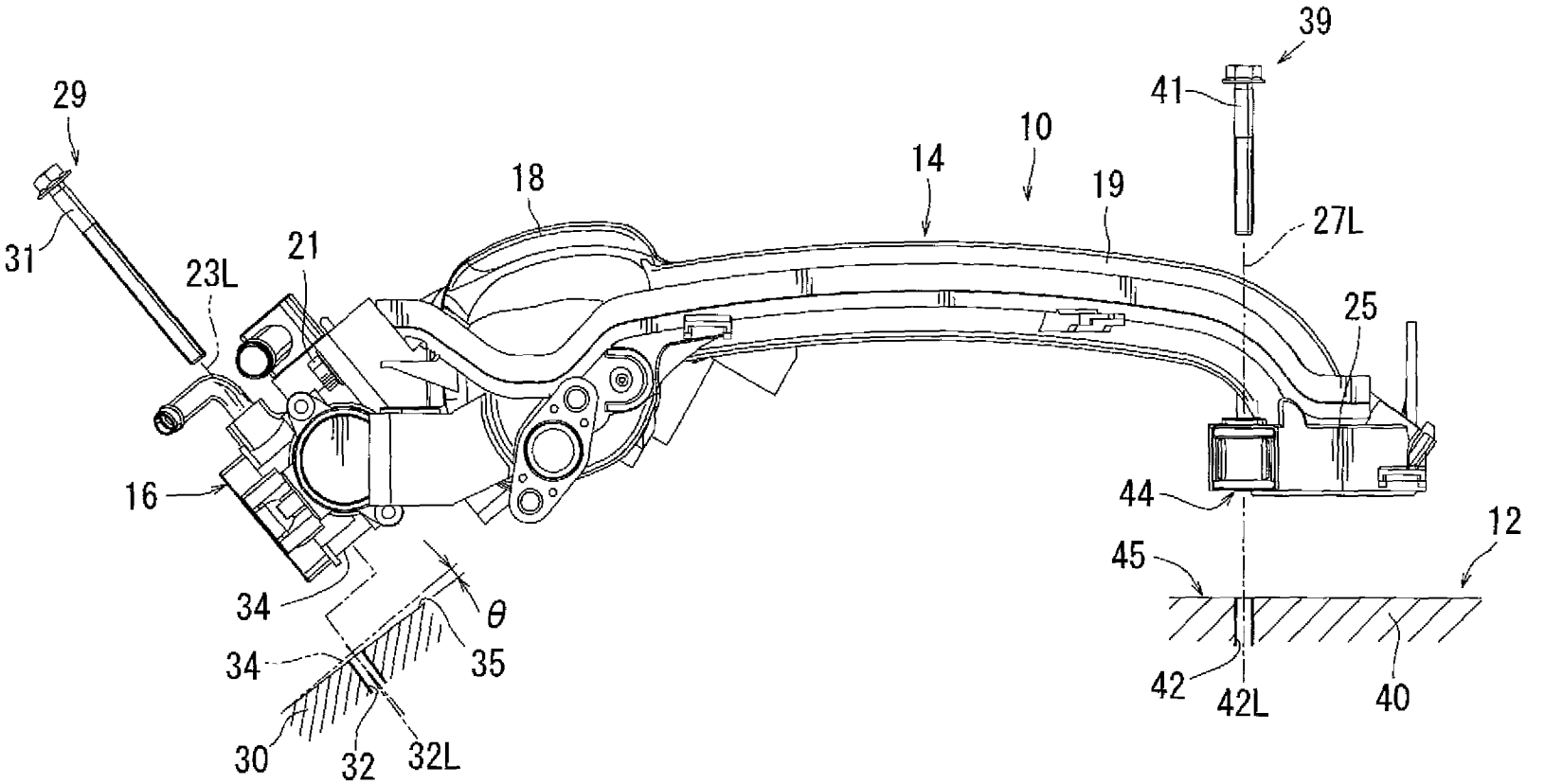
FIG. 8 is a front view similar to FIG. 1 but showing the intake manifold in a free state.

Referring to FIG. 8, the intake manifold 10 is shown in a state before being fixed to the engine 12 (i.e. a free state). As shown in FIG. 8, the first installation surface 35 of the bracket 30 of the first mounting device 29 is configured as a flat surface inclined relative to the first mount surface 34 of the throttle body 16 by an angle of θ. Thus, the first installation surface 35 and the first mount surface 34 are inclined relative to each other by the angle of θ. For example, the angle of θ may be 3°. In addition, the first installation surface 35 is inclined such that the distance between the first installation surface 35 and the first mount surface 34 is larger on the air outlet side along a longitudinal direction of the manifold body 14 (or on the right side as viewed in FIG. 8) than the distance on the air inlet side or the left side. The axes 32L of the first threaded holes 32 extend perpendicular to the first installation surface 35.

The second installation surface 45 of the cylinder head 40 of the second mounting device 39 extends parallel to the second mount surface 44 of the manifold body 14. Therefore, the second installation surface 45 and the second mount surface 44 are inclined relative to each other by an angle of 0°. Here, the axes 42L of the second thread holes 42 extend perpendicular to the second installation surface 45.

The operation for mounting the intake manifold 10 to the bracket 30 and the cylinder head 40 by the first mounting device 29 and the second mounting device 39, respectively, as shown in FIG. 1 will now be described. As shown in FIG. 7, the end portion (right end portion) on the air outlet side of the intake manifold 10 is mounted to the cylinder head 40 by inserting the second bolts 41 of the second mounting device 39 into the second collars 27 of the mount flange 25 of the manifold body 14, threadably engaging the second bolts 41 with the second threaded holes 42 of the cylinder head 40, and tightening the second bolts 41 into the second threaded holes 42. As a result, the second mount surface 44 of the mount flange 25 is brought into surface-to-surface contact relationship with the second installation surface 45 of the cylinder head 40.

On the other hand, as shown in FIG. 5, the end portion (left end portion) on the air inlet side of the intake manifold 10 is mounted to the bracket 30 by inserting the first bolts 31 of the first mounting device 29 into the first collars 23 of throttle body 16, threadably engaging the first bolts 31 with the first threaded holes 32 of the bracket 30, and tightening the first bolts 31 into the first threaded holes 32. As a result, the first mount surface 34 of the throttle body 16 is brought into surface-to-surface contact relationship with the first installation surface 35 of the bracket 30. As described previously, in this first mounting device 29, the first installation surface 35 of the bracket 30 and the first mount surface 34 of the throttle body 16 are inclined relative to each other by the angle of θ in the free state (see FIG. 8). Therefore, as the throttle body 16 is fixed to the bracket 30 to bring the first mount surface 34 of the throttle body 16 into surface-to-surface contact relationship with the first installation surface 35 of the bracket 30, a bending moment is applied to the intake manifold 10.

According to the fixing structure of the intake manifold 10 described above, the throttle body 16 of the intake manifold 10 is fixed to the bracket 30 of the engine 12 by the first mounting device 16, while the mount flange 25 of the manifold body 14 of the intake manifold 10 is fixed to the cylinder head 40 by the second mounting device 39. Then, a fixing force applied to the bracket 30 of the engine 12 for fixing the throttle body 16 to the bracket 30 by the first mounting device 29 can apply a bending moment to the manifold body 14. Therefore, it is possible to prevent or reduce local vibrations that may be produced at a portion(s) having low rigidity (such as the intake pipes 19 of the resin manifold body 14) of the intake manifold 10 fixed to the engine 12.

Further, the throttle body 16 integrated with the air inlet side of the manifold body 14 is fixed to the bracket 30 of the engine 12 by the first mounting device 29. The first installation surface 35 of the bracket 30 and the first mount surface 34 of the throttle body 16, to which the first installation surface 35 contacts, are inclined relative to each other by the angle of θ in the free state (see FIG. 8). Therefore, as the throttle body 16 is fixed to the bracket 30 to bring the first mount surface 34 of the throttle body 16 into surface-to-surface contact relationship with the first installation surface 35 of the bracket 30, a bending moment is applied to the intake manifold 10.

SECOND EXAMPLE

A second example will now be described with reference to FIG. 9. This example is a modification of the first example, and therefore, like members are given the same reference numerals as the first example and the description of these members will not be repeated.

Figure 9:
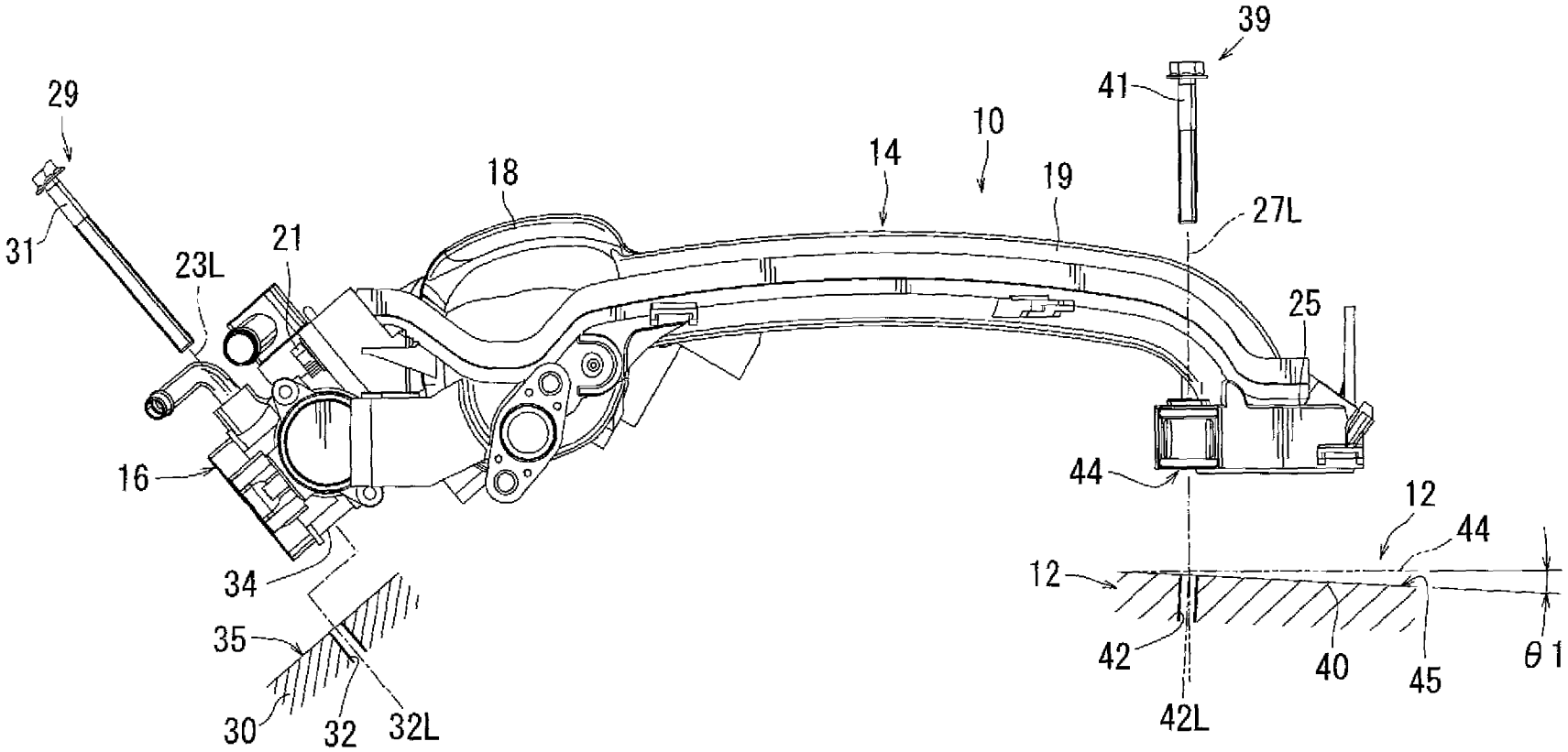
FIG. 9 is a front view of an intake manifold and a fixing structure for fixing the intake manifold to an engine according to a second example, and showing the intake manifold in a free state.

As shown in FIG. 9, in the free state of the intake manifold 10, the first installation surface 35 of the bracket 30 of the first mounting device 29 extends parallel to the first mount surface 34 of the throttle body 16. Therefore, the angle of θ between the first installation surface 35 and the first mount surface 34 is 0°.

On the other hand, the second installation surface 45 of the cylinder head 40 of the second mounting device 39 is inclined relative to the second mount surface 44 of the mount flange 25 of the manifold body 14 by an angle of θ1. Therefore, the second installation surface 45 is inclined such that the distance between the second installation surface 45 and the second mount surface 44 is larger on the air outlet side along the longitudinal direction of the manifold body 14 (or on the right side as viewed in FIG. 9) than the distance on the air inlet side or the left side.

Thus, in this second mounting device 39, the second installation surface 45 of the cylinder head 40 of the engine 12 and the second mount surface 44 of the mount flange 25 of the manifold body 14 of the intake manifold 10, which is intended to contact the second installation surface 45, are inclined relative to each other by the angle of θ1 in the free state. Therefore, as the mount flange 25 of the manifold body 14 of the intake manifold 10 is fixed to the cylinder head 40 of the engine 12, the second mount surface 44 of the mount flange 25 of the manifold body 14 of the intake manifold 10 is brought into surface-to-surface contact relationship with the second installation surface 45 of the cylinder head 40 of the engine 12. As a result, a bending moment is applied to the intake manifold 10.

THIRD EXAMPLE

A third example will, now be described with reference to FIG. 10. This example is also a modification of the first example, and therefore, like members are given the same reference numerals as the first example and the description of these members will not be repeated.

Figure 10:
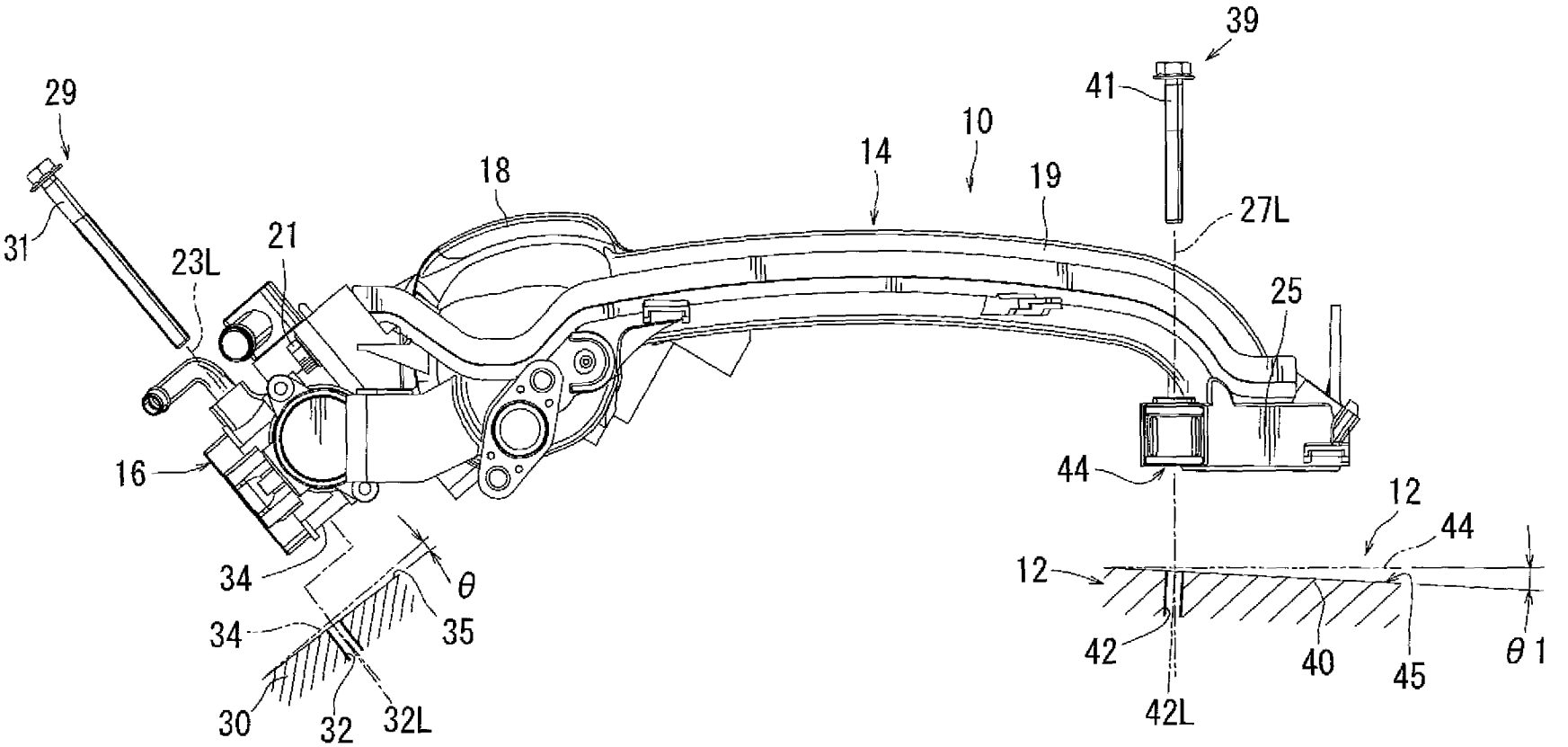
FIG. 10 is a front view of an intake manifold and a fixing structure for fixing the intake manifold to an engine according to a third example, and showing the intake manifold in a free state.

As shown in FIG. 10, in the free state of the intake manifold 10, similar to the first example, the first installation surface 35 of the bracket 30 of the first mounting device 29 is inclined relative to the first mount surface 34 of the throttle body 16 by the angle of θ that is not 0°.

On the other hand, similar to the second example, the second installation surface 45 of the cylinder head 40 of the second mounting device 39 is inclined relative to the second mount surface 44 of the mount flange 25 of the manifold body 14 by the angle of θ1 that is not 0°.

(Other Possible Modifications)

The above examples may be modified in various ways. For example, although the intake manifold 10 of the above examples has the throttle body 16, the present teachings can be applied to an intake manifold that has only the manifold body 14. In addition, in the above examples, the installation surface (the first installation surface 35 and/or the second installation surface 45) is inclined such that the distance between the installation surface and the mount surface (the first mount surface 34 and/or the second mount surface 44) is larger on the air outlet side along the longitudinal direction of the manifold body 14 (or on the right side) than the distance on the air inlet side (or on the left side). However, the installation surface may be inclined such that the distance between the installation surface and the mount surface is larger on the air inlet side (or on the left side) than the distance on the air outlet side or the right side. Alternatively, the mount surface (the first mount surface 34 and/or the second mount surface 44) may be configured as an inclined surface that is inclined relative to the installation surface (the first installation surface 35 and/or the second installation surface 45).

What is claimed is:

1. A fixing structure for fixing an intake manifold to an engine, the intake manifold having a manifold body for distributing intake air into cylinders of an engine, and the manifold body including a first end portion on an air inlet side of the intake manifold, a second end portion on an air outlet side of the intake manifold, a surge tank on the side of the first end, and a plurality of resiliently deformable intake pipes arranged in parallel to each other and each having a lower rigidity than that of the surge tank and extending substantially linearly between the surge tank and the second end portion, the fixing structure comprising:

a first mounting device capable of fixedly mounting the first end portion of the intake manifold body to the engine by a first fixing force; and a second mounting device capable of fixedly mounting the second end portion of the intake manifold body to the engine by a second fixing force;

wherein at least one of the first and second fixing forces applies a bending moment to the intake pipes of the intake manifold body so as to prevent local vibrations of the intake pipes.

2. The fixing structure as in claim 1, wherein:

the first mounting device comprises a first installation surface provided on the engine and a first mount surface provided on the intake manifold for contacting with the first installation surface; and the second mounting device comprises a second installation surface provided on the engine and a second mount surface provided on the intake manifold for contacting with the second installation surface.

3. The fixing structure as in claim 2, wherein:

the first installation surface and the first mount surface are inclined relative to each other by a first angle when the intake manifold is free from the bending moment.

4. The fixing structure as in claim 3, wherein the second installation surface and the second mount surface are inclined relative to each other by a second angle when the intake manifold is free from the bending moment.

5. The fixing structure as in claim 1, wherein:

the first end portion of the intake manifold includes a throttle body integrated with an air-intake side portion of the manifold body; and the throttle body includes the first mount surface.

6. The fixing structure as in claim 1, wherein:

the manifold body is made of resin; and the bending moment is applied to the intake pipes in a direction perpendicular to the direction of arrangement of the intake pipes.

7. The fixing structure as in claim 2, wherein the first and second installation surfaces are inclined relative to each other.

8. An apparatus comprising:

an intake manifold including a manifold body having a first end portion and a second end portion on an air outlet side of the intake manifold, a surge tank on the side of the first end, and a plurality of resiliently deformable intake pipes arranged in parallel to each other and each having a lower rigidity than that of the surge tank and extending substantially linearly between the surge tank and the second end portion;

wherein the first end portion and the second end portion includes a first mount surface and a second mount surface, respectively;

a first installation portion and a second installation portion provided on an engine;

wherein the first installation portion and the second installation portion include a first installation surface and a second installation surface, respectively;

a first mounting device capable of mounting the first end portion of the intake manifold body to the first installation portion of the engine, so that the first mount surface and the first installation surface contact with each other when the first end portion is mounted to the first installation portion by the first mounting device;

a second mounting device capable of mounting the second end portion of the intake manifold body to the second installation portion of the engine, so that the second mount surface and the second installation surface contact with each other when the second end portion is mounted to the second installation portion by the second mounting device;

wherein the first mount surface and the second mount surfaces are inclined relative to each other by a first angle before the intake manifold body is mounted to the engine by the first and second mounting devices; and wherein the first installation surface and the second installation surface are inclined relative to each other by a second angle that is different from the first angle, so that the intake pipes resiliently deform so as to be prevented from local vibrations when the intake manifold body is mounted to the engine by the first and second mounting devices.

9. The apparatus as in claim 8, wherein:

the manifold body is made of resin.

10. An apparatus comprising:

a mounting device capable of mounting an intake manifold to an engine, the intake manifold comprising a manifold body including a surge tank and a plurality of resiliently deformable intake pipes arranged in parallel to each other and each having a lower rigidity than that of the surge tank and extending substantially linearly;

wherein the mounting device comprises a bending moment applying device applying a bending moment to the intake pipes of the intake manifold as the intake manifold is mounted to the engine, so that the intake pipes are prevented from local vibrations.

* * * * *